10/8/85 XR 4,545,946

United States Patent [19]

Sarja

[11] Patent Number: 4,545,946

[45] Date of Patent: Oct. 8, 1985

[54] METHOD AND EQUIPMENT FOR THE COMPACTING OF CONCRETE

[75] Inventor: Asko Sarja, Espoo, Finland

[73] Assignee: Sr-Kone Oy, Salpakangas, Finland

[21] Appl. No.: 578,504

[22] Filed: Feb. 9, 1984

[30] Foreign Application Priority Data

Feb. 9, 1983 [FI] Finland ..... 830454

[51] Int. Cl.[4] ..... B28B 1/08; B28B 5/02; B28B 23/18

[52] U.S. Cl. ..... 264/70; 198/766; 264/333; 366/109; 425/371; 425/456

[58] Field of Search ..... 425/421, 371, 456, 370, 425/223; 264/70, 71, 69; 100/154, 153; 366/109; 198/764-766

[56] References Cited

U.S. PATENT DOCUMENTS

| | | | |
|---|---|---|---|
| 842,356 | 1/1907 | Stone | 425/371 |
| 1,185,399 | 5/1916 | Hayes | 425/371 |
| 2,281,860 | 5/1942 | Renault | 425/371 |
| 2,365,804 | 12/1944 | Clerke | 425/371 |
| 2,575,092 | 11/1951 | Bouvier et al. | 425/456 |
| 2,670,515 | 3/1954 | Wigley | 425/456 |
| 2,835,016 | 5/1958 | Dixon | 264/71 |
| 3,063,362 | 11/1962 | Guettler | 100/154 |
| 3,191,522 | 6/1965 | Drake et al. | 198/626 |
| 3,250,835 | 10/1966 | Kozlov | 425/100 |
| 3,313,010 | 4/1967 | Betz | 425/371 |
| 3,565,650 | 2/1971 | Cordon | 264/112 |
| 3,883,284 | 5/1975 | De Mets | 425/371 |
| 3,883,285 | 5/1975 | De Mets | 425/371 |
| 3,907,473 | 9/1975 | De Mets | 425/371 |
| 3,942,927 | 3/1976 | De Mets | 425/406 |
| 4,004,873 | 1/1977 | De Mets | 425/371 |
| 4,197,792 | 4/1980 | Mendoza | 425/371 |
| 4,247,269 | 1/1981 | Bezhanov et al. | 425/456 |
| 4,449,910 | 5/1984 | Leloux | 425/370 |

FOREIGN PATENT DOCUMENTS

| | | | |
|---|---|---|---|
| 2037442 | 10/1972 | Fed. Rep. of Germany . | |
| 3046525 | 8/1981 | Fed. Rep. of Germany . | |
| 1889/72 | 1/1981 | Finland . | |
| 572324 | 6/1924 | France | 100/152 |
| 8203143-6 | 5/1982 | Sweden . | |
| 235586 | 6/1969 | U.S.S.R. . | |
| 556035 | 7/1977 | U.S.S.R. . | |
| 961960 | 9/1982 | U.S.S.R. . | |

*Primary Examiner*—Willard E. Hoag
*Attorney, Agent, or Firm*—Burns, Doane, Swecker & Mathis

[57] ABSTRACT

Method and equipment for compacting of concrete mix when concrete products are being cast by means of a continuous method. The concrete mix is carried from the feeder device (4) forwards by means of an endless transfer unit. The compression required for the compacting of the concrete mix is produced by means of a roll (1) pressed against the transfer face (2). The compression is directed at the concrete mix by the intermediate of rigid plates (2) of a caterpillar band constituting the transfer unit, which plates are pressed against the concrete mix by means of two or more support rolls (1).

9 Claims, 1 Drawing Figure

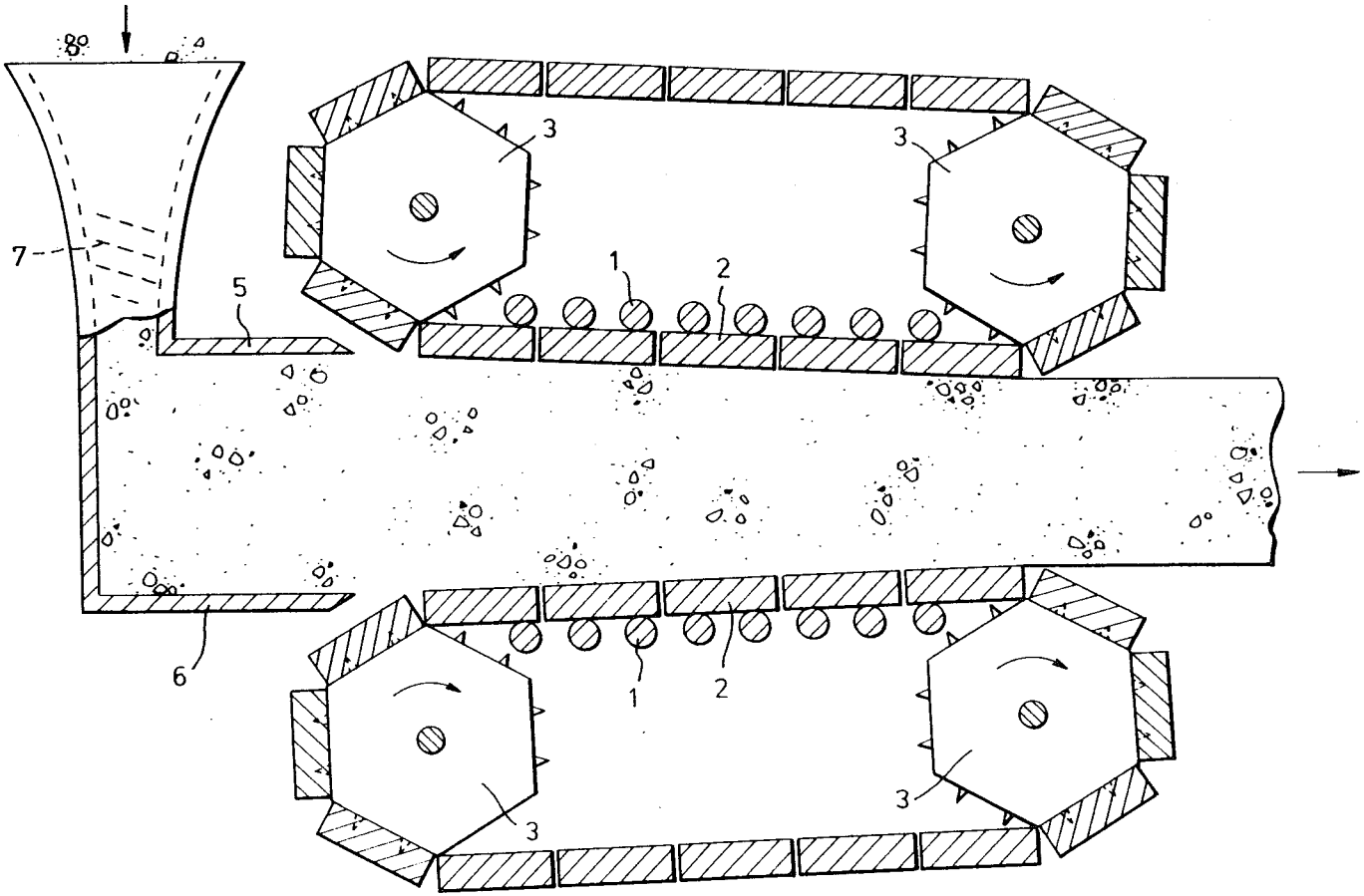
1
2
3
5
6
7

METHOD AND EQUIPMENT FOR THE COMPACTING OF CONCRETE

The present invention is concerned with a method for the compacting of concrete mix when concrete products are being cast by means of a continuous method, whereat the concrete mix is carried from the feeder device forwards by means of an endless transfer unit and the compression required for the compacting of the concrete mix is produced by means of a roll pressed against the transfer face. The invention is also concerned with equipment for carrying out the method, which equipment is provided with a feeder device for feeding the concrete mix and with a compression member for compacting the concrete mix.

In the manufacture of concrete products, it is known in prior art to use a so-called band-rolling method, in which the concrete mix is pulled between steel bands. The mix is compacted by means of a pair of rolls placed at both sides of the bands. At the rolls, a sudden compression, based on very high pressure, is produced. It is a difficulty involved in the band rolling that the sudden compacting taking place at the rolls produces internal cracks and cavities in the concrete, because of which the mix must have a very high content of cement and a small particle size.

A method is also known for the manufacture of board-shaped concrete products so that the mix placed in the mould is compacted by means of a vibrator beam.

The method of the present invention is mainly characterized in that the compression is directed at the concrete mix by the intermediate of rigid plates of a caterpillar band constituting the transfer unit, which plates are pressed against the concrete mix by means of two or more support rolls. According to a particularly favourable embodiment, the support rolls are vibrated. The equipment of the invention is mainly characterized in that the compression unit consists of a caterpillar belt consisting of rigid plates and of support rolls pressing the plates against the mix.

Advantages of the method of compacting in accordance with the present invention as compared with the prior-art methods, either vibration alone or rolling by means of round rolls, are:

- simultaneous operation of the rolls as generators of pressure, as conveyors of concrete mix or compacting machine, and possibly as vibrators,
- easy adjustability of the compression pressure and of its distribution by means of the support rolls; adjustment may also be performed during the process, whereby uniform quality of the compacted concrete is ensured and micro-cracking and other defects of the concrete are avoided, which defects are readily produced, e.g., on ordinary compacting by means of rolling,
- efficiency of the compacting, because the pressure and the intensity of vibration can be combined in a way suitable for the concrete mix and for the product,
- low noise level as compared with conventional vibration, because by using pressure, it is possible to reduce or even to eliminate vibration which causes noise,
- the concreting speed can be varied by accordingly adjusting the rate of compacting by changing the position of the support rolls.

The invention and its details will be described in more detail below with reference to the attached drawing, which is a schematical and partly sectional side view of a device in accordance with the invention.

The equipment is provided with two caterpillar belts consisting of belt plates 2, circulating around transfer wheels 3, fitted opposite each other, and supported by means of roller-shaped support rolls 1. The support rolls may be vibratable. Their spacing is preferably at the maximum one half of the width of the plates 2, whereat, in all positions of the caterpillar belt, there are always at least two support rolls positioned against each plate. The transfer wheels 3 are provided with pins 7, which fit into holes provided at the ends of the plates 2.

The support rolls 1 and the transfer wheels 3 are, at their ends, supported against each other or against the frame (not shown in the drawing) of the compacting device so that the space between opposite support rolls and, consequently, also the space between the caterpillar belts can be adjusted. The support of the support rolls may be resilient, e.g., by means of springs or electrically controlled cylinders.

At one end of the caterpillar belts, a feeder device 4 is provided. The top portion of the feeding opening of the feeder device, which opening opens itself towards the caterpillar belts, is connected with a horizontal adjusting plate 5, whose height can be adjusted and which may also be provided with slight vibration. At the opposite side of the adjusting plate, there is the mix-feeding bottom 6. The feeding bottom may also be provided with additional vibration.

The concrete mix is fed into the compacting device out of the feeder device 4 and the quantity of mix is controlled by means of the adjusting plate 5. The adjusting plate 5 may also be vibrated slightly. When the transfer wheels 3 revolve in the direction indicated by the arrows, the plates 2 of the caterpillar belts carry the concrete mix forwards, or alternatively, they carry the compacting machine in the opposite direction. The concrete mix is subjected to pressure by means of the plates 2 supported by means of support rolls 1, and possibly additionally to vibration, generated, e.g., via the support rolls. Thus, when the plates 2 move on the rolls 1, they at the same time compact the concrete mix and force its faces into a specified shape.

The thickness of the mix layer that is being compacted can be adjusted by changing the space between opposite supports rolls 1. When resilient suspension of the plates 2 of the caterpillar belt is used, the pressure at the plates is equalized.

The compacting caterpillar belts may act upon the mix to be compacted to board form either from one side against the concreting base or from both sides, as is shown in the drawing. If one-sided compacting is used, a concreting base is used in stead of the mix-feeding bottom 6. When pieces of rectangular section are produced, it is possible to use two pairs of rolls placed perpendicularly to each other and at the distances of the dimensions of the sides of the beam from each other. Beams with sections of six or more angles may also be produced by using three or more pairs of rolls.

The plates of the caterpillar belts may have smooth compacting faces, or these faces may be patterned, grooved or otherwise profiled in any desired way, in which case they also determine the shape of the face or faces of the product that is produced. If it is desirable to eliminate the trace of the joint between the plates of the caterpillar belts off the concrete, it is possible to use a smoothing plate on the caterpillar belt. If it is desirable to provide the product, e.g., with cavities, the device may be additionally provided with parts that form the cavities, which parts may also be provided with vibration.

What is claimed is:

1. A method of compacting concrete mix during the continuous casting of concrete products comprising the steps of providing a feeding device and an endless transfer unit which includes rigid plates of a caterpillar band and two or more support rolls, feeding concrete through said feeder device to the endless transfer unit, conveying the concrete through the endless transfer unit, and while the concrete is in the transfer unit, pressing the plates of the caterpillar band by means of said support rolls, adjusting the pressure applied by the plates by changing the position of said support rolls, and vibrating said support rolls.

2. A method as claimed in claim 1, including the steps of passing the concrete mix between a caterpillar belt and a base, and compressing the mix between the plates in the caterpillar belt and the base.

3. A method as claimed in claim 1 including the step of passing the concrete mix between a pair of caterpillar belts each having rigid plates and support rolls pressing against the plates.

4. An apparatus for the continuous casting of concrete products comprising a feeder device for feeding concrete mix and an endless transfer unit, said endless transfer unit comprising means for compacting the concrete mix including a caterpillar belt having a plurality of rigid plates and support rolls for pressing the plates against the concrete mix, said plates being movable to by-pass said support rolls, means for adjusting the distance between said support rolls and means for vibrating said support rolls.

5. An apparatus as claimed in claim 4, wherein the distance between adjoining support rolls is no greater than half the width of the plates of the caterpillar belt.

6. An apparatus as claimed in claim 4 wherein several pairs of caterpillar belts are provided and each pair of caterpillar belts can be pressed towards each other by means of support rolls.

7. An apparatus as claimed in claim 5 wherein several pairs of caterpillar belts are provided and each pair of caterpillar belts can be pressed towards each other by means of support rolls.

8. An apparatus as claimed in claim 4, wherein a concrete base is provided and said caterpillar belt is pressed toward said concrete base by means of the support rolls.

9. An apparatus as claimed in claim 5, wherein a concrete base is provided and said caterpillar belt is pressed toward said concrete base by means of the support rolls.

* * * * *